United States Patent [19]

Gaston et al.

[11] 4,334,413

[45] Jun. 15, 1982

[54] ADJUSTABLE NECKLACE CONSTRUCTION

[76] Inventors: Paul Gaston, 99 Alta Ave., Yonkers, N.Y. 10705; Morton W. Schwartz, 305 E. 24th St., New York, N.Y. 10010

[21] Appl. No.: 205,106

[22] Filed: Nov. 10, 1980

[51] Int. Cl.[3] ..... A44C 25/00

[52] U.S. Cl. ..... 63/2; 24/116 R; 24/115 R

[58] Field of Search ..... 63/1, 2, 5 R; 24/115 H, 24/116 R, 116 A, 115 R; 46/28, 29

[56] References Cited

U.S. PATENT DOCUMENTS

| | | | |
|---|---|---|---|
| 1,124,518 | 1/1915 | Qvarnstrom | 24/115 R |
| 1,878,373 | 9/1932 | Breeser | 46/28 |
| 2,462,425 | 2/1949 | Pratt | 63/2 |
| 2,637,884 | 5/1953 | Morehouse | 24/115 R X |
| 3,187,396 | 6/1965 | Carroll | 24/115 R |
| 3,974,545 | 8/1976 | Lossini | 24/116 A |

FOREIGN PATENT DOCUMENTS

| | | | |
|---|---|---|---|
| 772982 | 8/1934 | France | 63/2 |
| 319690 | 4/1957 | Switzerland | 63/1 R |
| 16468 | of 1887 | United Kingdom | 63/5 R |

*Primary Examiner*—F. Barry Shay

*Attorney, Agent, or Firm*—Charles E. Temko

[57] ABSTRACT

An adjustable necklace of a type in which a length of chain has first and second ends which are each anchored in one of a pair of adjustment elements with a segment adjacent the other end passing through the adjustment element to be resiliently held in position to effect a given adjustment. The adjustment elements each include first and second mating members which enclose an anchor for one end of the chain, a resilient frictional member, and first and second mating housing members having mutually interlocking means permitting rapid assembly with an absence of a soldering operation.

4 Claims, 4 Drawing Figures

ADJUSTABLE NECKLACE CONSTRUCTION

BACKGROUND OF THE INVENTION

This invention relates generally to the field of jewelry, such as necklaces and bracelets, and more particularly to an improved form of adjustable type in which the ends of a single length of chain are anchored within an adjustment element which also slidingly accommodates a segment of chain adjacent an opposite end of the chain, whereby by a simple sliding movement therebetween, the effective length of the closed loop is varied to a desired degree. Devices of this general type are well known in the art, and the invention lies in specific constructional details which facilitate manufacture of the component parts, as well as the assembly thereof.

In the manufacture of jewelry, it is conventional to solder various components together for purpose of integration. Where the parts of the article of jewelry have no related motion after assembly, such procedure is entirely satisfactory. When resilient elements are involved, the heat developed during soldering operates to destroy non-metallic resilient components, and to anneal the resilient temper of metallic ones. Devices of the instant type, as a consequence, have not been easy to manufacture in a relatively inexpenive manner, and, as a result, such devices often have been manufactured of synthetic resinous materials to be used as neck straps for spectacles, and photographic equipment, or, when manufactured to include metallic adjustment element, the resilient components have been incorporated by resort to the resilient qualities possessed by a non-metallic strap in lieu of a metallic chain. Such modifications render the device unsuitable for use as decorative jewelry because of a resultant inherently functional appearance.

It is, of course, known in the jewelry art to provide caselike elements which mate in the manner of the parts of a watchcase. However, such elements are maintained in assembled condition either by force fitting or by cooperating detents which offer little mechanical strength when a plurality of components to be encased extend outwardly of the case and are subjected to tension in the plane of the case.

SUMMARY OF THE INVENTION

Briefly stated, the invention contemplates the provision of an improved device of the class disclosed in which the above mentioned disadvantages of the prior art have been substantially eliminated. The inventive structure includes a pair of nesting casing members for each adjustable element which are of substantially trapezoidal configuration. One of the nesting members is provided with side walls having elongated openings, the edges of which cam corresponding tongues on the side walls of the other of the members as the two members are slid together to nesting relation, so that assembly requires substantially little applied force and full seating of the parts includes a snap action. The assembly accurately positions the ends of the chain which have been previously soldered to trapezoidally-shaped anchors disposed within the casing members. The resilient member provided in each adjustment element for providing frictional resistance to movement of a chain segment within the adjustment element may be of either synthetic or natural resin, or may be in the form of a tempered metallic strip. In either case, because assembly takes place in the absence of a soldering operation, neither form is deleteriously affected.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
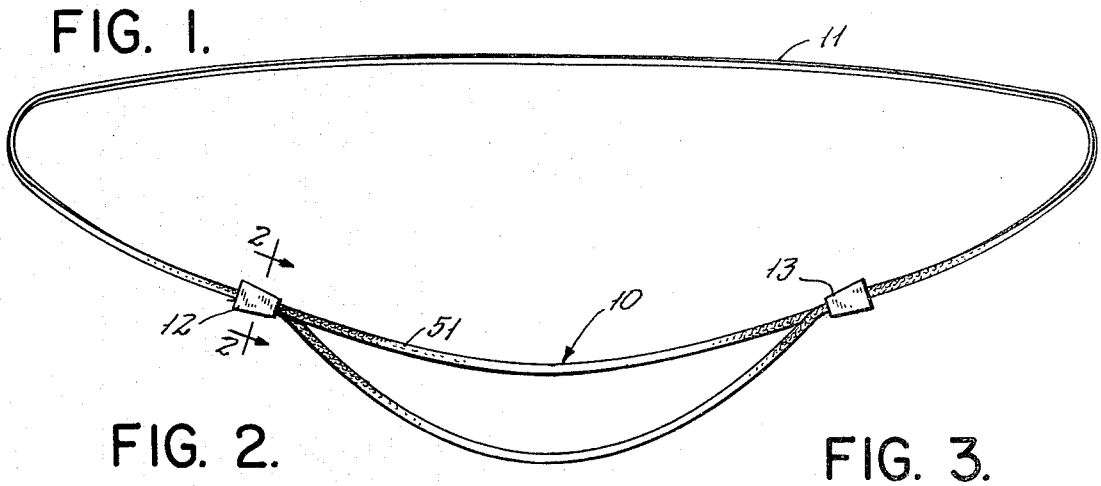
FIG. 1 is a view in elevation of an embodiment of the invention.
Figure 2:
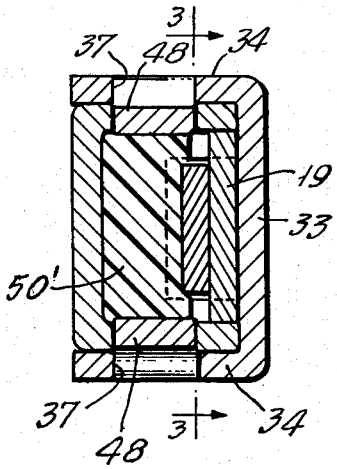
FIG. 2 is an enlarged sectional view thereof as seen from the plane 2—2 in FIG. 1.

In accordance with the invention, the device, generally indicated by reference character 10, comprises broadly: a single chain element 11 and first and second adjustment elements 12 and 13, respectively.

Figure 3:
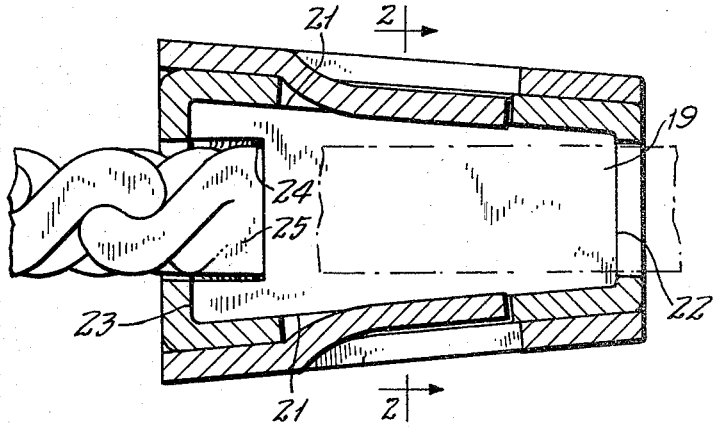
FIG. 3 is a fragmentary sectional view as seen from the plane 3—3 in FIG. 2.

The chain element 11 may comprise a well known link type chain of precious or base metal, or, if desired, may be formed as a continuous length of flexible wire. The ends thereof are soldered or otherwise secured to first and second terminal blocks 19 of generally trapezoidal shape. Each terminal block includes a pair of long side edges 21, a short end edge 22 and a longer end edge 23 having a recess 24 accommodating the chain terminal 25 (See FIG. 3).

Figure 4:
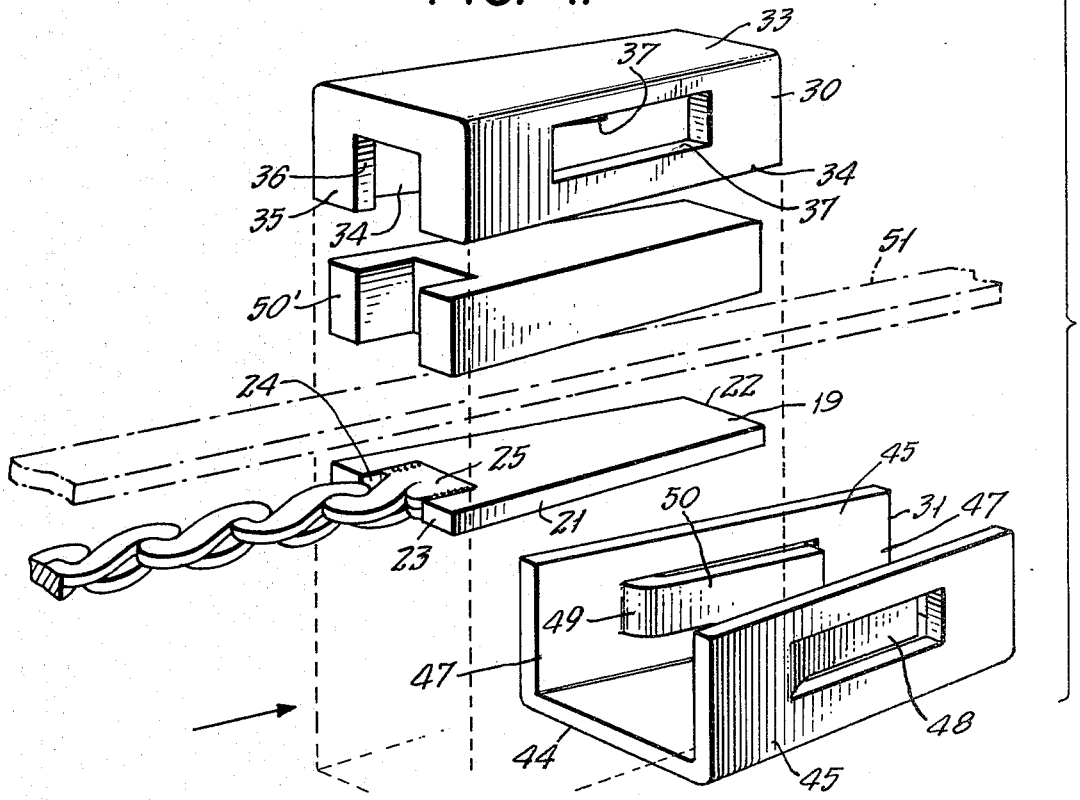
FIG. 4 is an exploded view in perspective of the structure shown in FIG. 2.

The elements 12 and 13 are identical, and accordingly, a detailed description of one of said elements will serve equally well to describe the other. Referring to FIG. 4, the element 12 includes first and second casing members 30 and 31 of generally trapezoidal configuration. The first or inner member 30 includes a main wall 33, a pair of side walls 34 and at least one end wall 35 defining an opening 36. The side walls are provided with rectangular openings 37.

The member 31 is of corresponding configuration to enable a mutually nesting relationship. It includes a main wall 44, a pair of side walls 45 defining openings 47. The side walls 45 are each provided with punched out tongues 48, each including an angularly disposed portion 49 and a rectilinear portion 50.

When the elements 12 and 13 are assembled, a generally planar resilient member 50 is positioned therein, wherein one surface thereof engages a surface of the terminal block 19, while the other surface is adapted to bear against a segment 51 of the chain element 11 passing through the element 12. The member 50 may be formed of either natural or synthetic rubber, or, in the alternative, may be a thin wafer of phosphor, bronze or the like. As it is also of trapezoidal configuration, once positioned within the casing members, it will not shift during movement of the segment within the adjustment element.

Assembly of each of the elements 12 and 13 will be apparent from a consideration of FIG. 4. Commencing with the chain element in assembled condition, a terminal is positioned within one of the members 30–31, and the resilient member 50 positioned thereupon. Next, the chain segment is positioned upon the resilient member, and the casing members 30 and 31 are slid together, while maintaining some degree of force normal to the plane of the element 12 during such movement, to prevent distortion. As the casing members are slid together, the tongues 48 will be slightly deflected inwardly until the rectilinear portions 39 are opposite the corresponding rectangular openings 37, at which point a snap action occurs and the adjustment element is fully assembled. The same procedure is followed for the adjustment element 13 to result in a fully assembled device 10.

We wish it to be understood that we do not consider the invention limited to the precise details of structure shown and set forth in this specification, for obvious modifications will occur to those skilled in the art to which the invention pertains.

We claim:

1. In an improved adjustable length necklace, including a single length of chain and first and second adjustment elements, each mounting an end of said chain and having resilient means bearing upon a segment of said chain adjacent an opposite end, the improvement comprising: said adjustment elements including first and second casing members, said first casing member including a main wall of generally planar trapezoidal configuration, a pair of converging side walls defining openings at each end thereof; said second casing member including a main wall, first and second converging side walls defining corresponding openings at each end thereof; said walls on said first and second casing members having cooperating latching means thereon including an elongated opening in each of one pair of walls and a resilient tongue on each of a second pair of walls, said tongues including a first offset portion and a second rectilinear portion lying in a plane substantially parallel to that of a respective wall; said first and second casing members being maintained in nested relation by the mutual engagement of said latching means; and a trapezoidally-shaped terminal block attached to each end of said chain, and maintained in position between said first and second casing members.

2. The improvements set forth in claim 1, said resilient means comprising a generally planar resilient member overlying said terminal block within said nested casing elements and positioned to bear upon a segment of chain passing therebetween.

3. The improvements set forth in claim 2, in which said resilient member is formed of rubber.

4. The improvements set forth in claim 2, in which said resilient member is formed of metal.

* * * * *